US009660351B2

(12) United States Patent
Medzmariashvili et al.

(10) Patent No.: US 9,660,351 B2
(45) Date of Patent: May 23, 2017

(54) DEPLOYABLE ANTENNA FRAME

(71) Applicant: European Space Agency, Paris (FR)

(72) Inventors: Elguja Medzmariashvili, Tbilisi (GE); Nodar Tsignadze, Tbilisi (GE); Nikoloz Medzmariashvili, Tbilisi (GE); Leri Datashvili, Garching (DE); Alexander Ihle, Neufahrn bei Freising (DE); Julian B. Santiago Prowald, Wassenaar (NL); Cornelis Van't Klooster, Voorhout (NL)

(73) Assignee: European Space Agency, Paris (FR)

( * ) Notice: Subject to any disclaimer, the term of this patent is extended or adjusted under 35 U.S.C. 154(b) by 240 days.

(21) Appl. No.: 14/432,851

(22) PCT Filed: Oct. 1, 2012

(86) PCT No.: PCT/EP2012/069375
§ 371 (c)(1),
(2) Date: Apr. 1, 2015

(87) PCT Pub. No.: WO2014/053163
PCT Pub. Date: Apr. 10, 2014

(65) Prior Publication Data

US 2015/0288072 A1 Oct. 8, 2015

(51) Int. Cl.
*H01Q 15/16* (2006.01)
*H01Q 1/12* (2006.01)

(52) U.S. Cl.
CPC ..... *H01Q 15/161* (2013.01); *H01Q 1/1235* (2013.01)

(58) Field of Classification Search
CPC ..... H01Q 1/1235; H01Q 1/288; H01Q 15/161
(Continued)

(56) References Cited

U.S. PATENT DOCUMENTS 4,896,165 A * 1/1990 Koizumi ..... B64G 9/00 343/880
5,680,145 A 10/1997 Thomson et al.
(Continued)

FOREIGN PATENT DOCUMENTS

| | | |
|---|---|---|
| EP | 0959524 A1 | 11/1999 |
| SU | 429486 | 5/1974 |
| WO | 2012065619 A1 | 5/2012 |

OTHER PUBLICATIONS

Feb. 11, 2013 Written Opinion and International Search Report Issued in International Application No. PCT/EP2012/069375.

*Primary Examiner* — Graham Smith
*Assistant Examiner* — Daniel J Munoz
(74) *Attorney, Agent, or Firm* — Eversheds Sutherland (US) LLP

(57) ABSTRACT

A multi-faceted deployable antenna frame including a six-bar linkage structure in a lateral facet of the antenna frame, the six-bar linkage structure being convertible from a folded state into a deployed state and having two first bars and four second bars, each bar being coupled to two others by a hinge to form a closed loop, where in the deployed state, the six-bar linkage structure has a quadrilateral shape. The antenna frame also includes a deployment means for deploying the antenna frame by moving the six-bar linkage structures from the folded state into the deployed state, the deployment means including: a flexible, elongated member of a substantially inextensible material; a first guiding means provided at an end portion of one of the first bars and coupled to the elongated member; a storage means provided at the first bar that includes the first guiding means for storing a part of the elongated member; a driving means that is coupled to the elongated member to pull the elongated member to the storing means when deploying the antenna frame; and a second guiding means between two adjacent
(Continued)

second bars, the elongated member being coupled to the second guiding means. A first end of the elongated member is attached to the storing means and a second end of the elongated member is coupled to another first bar, and wherein the elongated member is extending between said first end and said second end along a plurality of second bars.

14 Claims, 4 Drawing Sheets

(58) Field of Classification Search
USPC ..... 343/881
See application file for complete search history.

(56) References Cited

U.S. PATENT DOCUMENTS

| | | | |
|---|---|---|---|
| 6,323,827 | B1 | 11/2001 | Gilger et al. |
| 2006/0181788 | A1 | 8/2006 | Harada et al. |
| 2009/0057492 | A1 | 3/2009 | Harris |

* cited by examiner

Fig. 7.
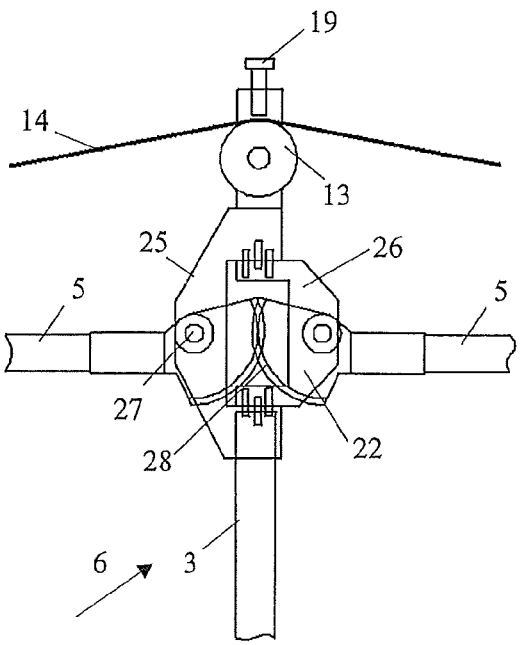
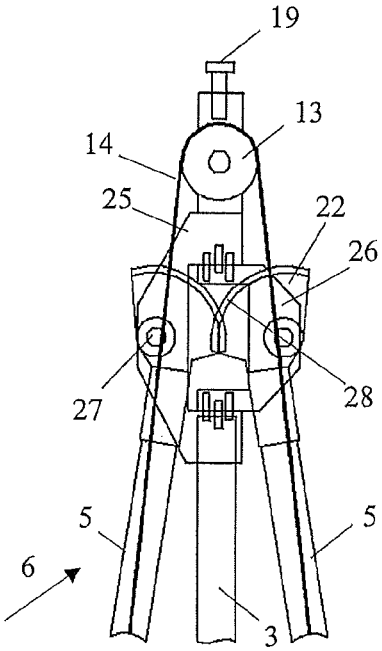
Fig. 8.
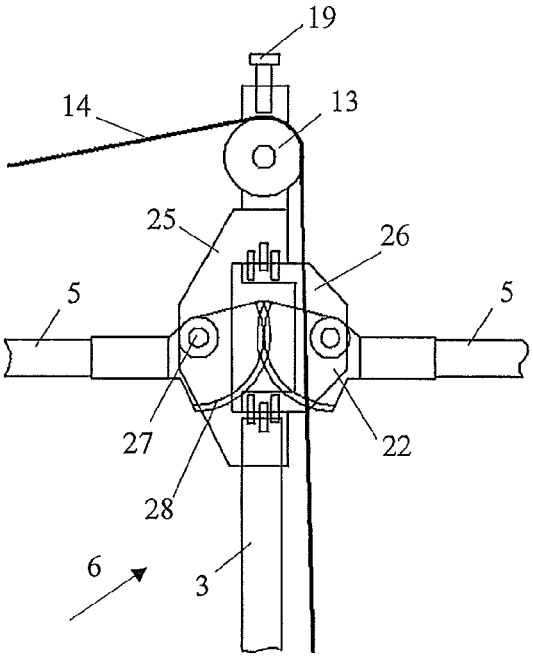
Fig. 9.
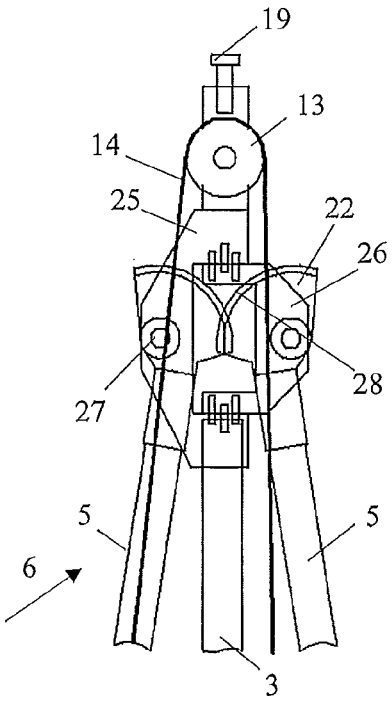

DEPLOYABLE ANTENNA FRAME

CROSS-REFERENCE TO RELATED APPLICATIONS

This application is a national stage application of International Application No. PCT/EP2012/069375, filed on Oct. 1, 2012. The disclosure of the prior application is hereby incorporated by reference herein in its entirety.

SUMMARY OF INVENTION

The six-bar linkage structures formed at the lateral facets of the antenna frame in combination with the centralizing driving means located at one of the first bars and the elongated member that couples the driving force of the centralized driving means to other first and second bars enables a particular light-weight assembly structure that can be stowed in a compact configuration.

In accordance with an aspect of the invention, the guiding means is arranged on top of one of the hinges located at an end portion of the first bar comprising the storage means and projecting outwardly in a longitudinal direction of the first bar. By way of example, the guiding means may be a pulley or roller and the elongated member may be a cable.

Preferably, at least two elongate members are provided, one extending along the second bars forming the upper side of the antenna frame and one extending along the second bars forming the lower side of the antenna frame. In this case, at least a second guiding means is located at an end portion of the first bar that is opposite of the end portion comprising the first guiding means.

In accordance with an aspect, the storage means may be provided at a center portion of the first bar so that it is located at an equal distance from the two guiding means located at opposite end portions of one of the first bars.

In accordance with an aspect, a second guiding means may be provided at the hinges coupling two adjacent second bars and the elongated member may be coupled to the second guiding means. Preferably, the elongated member is coupled to the second guiding means so that, in a deployed state of the antenna frame, the elongated member extends along a broken or zigzag line between the guiding means provided at the first bars.

In accordance with an aspect, the elongated member may extend along at least four second bars. It will be appreciated that number of second bars is not restricted to a particular number as the pulling force of the centralized driving means can be coupled to a varying number of second bars by the guiding means and the hinges.

In accordance with a further aspect, the antenna frame may comprise synchronising means provided at least at some of the hinges for synchronising the pivoting movement of the second bars relative to the first bars during deployment of the six-bar linkage structures. This synchronising mechanism may be achieved, for example through an interacting pairs of gears having a toothed disc shape. According to a further example, the synchronising means may comprise a slider strut slidably coupled to two adjacent first and second bars, wherein the slider strut moves upwardly along the first bar when the antenna frame is converted from the deployed state into the folded state.

In order to stiffen the upper and lower rings of the antenna frame formed by the second bars, the antenna frame may comprise connection cables extending between each adjacent first and second bars. A particular advantageous configuration of the connection cables may be achieved by attaching the connection cables to the center portions of adjacent first and second bars, so that the connection cables form a rhombic shape in the deployed state of the six bar linkage structure.

In order to keep the elongated member tensioned, the second end of the elongated member may be coupled to the another first bar by a spring.

In accordance with a further aspect, the driving means may comprise an electrical motor or a plurality of motors. The storage means may comprise a drum or a plurality of drums. By way of example, the storage means may comprise a first and a second drum, the first drum being configured to spool an elongated member extending along the plurality of second bars arranged at an upper side of the antenna frame and the second drum being configured to spool an elongated member extending along the plurality of second bars arranged at a lower side of the antenna frame.

In order to ensure favorable attack angles of the elongated member at the first and second bars, the first bars comprise upper and/or lower projecting ends. Preferably, the guiding means is attached at an end portion of the projecting end. In accordance with this aspect, the projecting ends may serve as a protection mechanism to prevent the elongated member from jumping off the guiding means.

In order to reduce the weight and increase the stiffness and modularity of the deployable reflector antenna frame and to ensure better stretching of the anterior mesh net which consists of cells, and to assume the high accuracy reflector profile, the antenna frame may have conical shape. Preferably, the conical shape is created by different lengths of the elongated member extending along the plurality of second bars arranged at an upper side of the antenna frame and the elongated member extending along the plurality of second bars arranged at a lower side of the antenna frame.

It is a particular advantage of the modular frame assembly that it can serve as a basis to build deployable antennas or antenna frames of different shapes. For instance, the antenna frame may comprise any number above two of lateral facets of identical or unequal shape forming a ring structure of regular or irregular polygonal shape.

BRIEF DESCRIPTION OF THE DRAWINGS

The invention is explained below in an exemplary manner with reference to the accompanying drawings, wherein

FIGS. 6 and 8 show front views of the coupling portion between first and second bars in the deployed state according to an embodiment; and FIGS. 7 and 9 show front views of the coupling portion between first and second bars in the folded state according to an embodiment.

FIG. 1 shows a deployable reflector antenna frame 1 having a cylindrical shape in the deployed state whereas FIG. 2 shows a different embodiment of a deployable reflector antenna frame having a conical shape.

DETAILED DESCRIPTION

Figure 1:
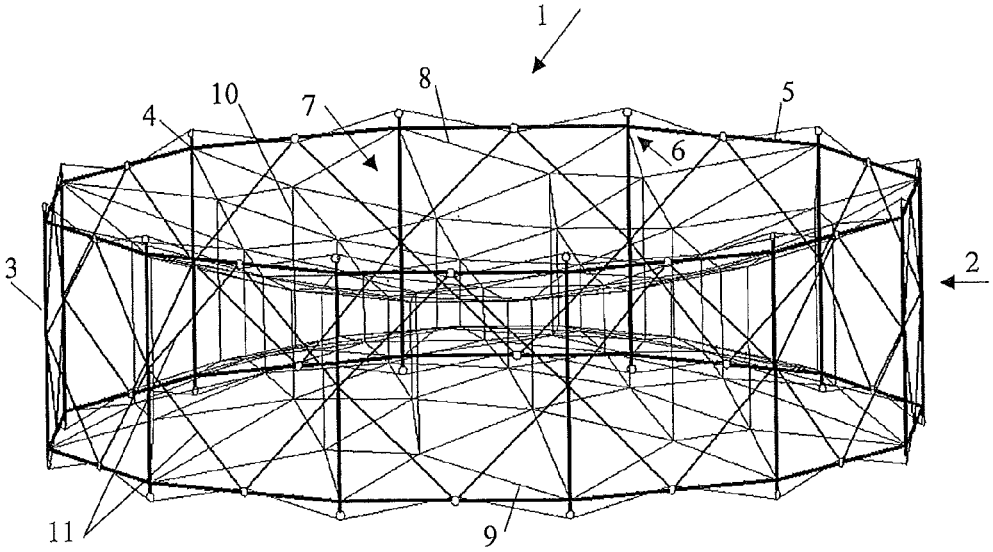
FIG. 1 shows a deployable reflector antenna frame with a cylindrical shape according to an embodiment.

The deployable reflector antenna frame 1 comprises a load-bearing ring 2 with vertical bars 3, V-fold bars 5 that are hinged with a revolute joint 4 to the vertical bars 3 and that form upper and lower chords, and interacting deployment synchronising means 6 provided at the coupling portions between vertical bars 3 and the V-fold bars 5. The V-fold bars 5 comprise two bars arranged in series and coupled by a center hinge 20 (not shown in FIGS. 1 and 2, cf. FIG. 3).

Figure 2:
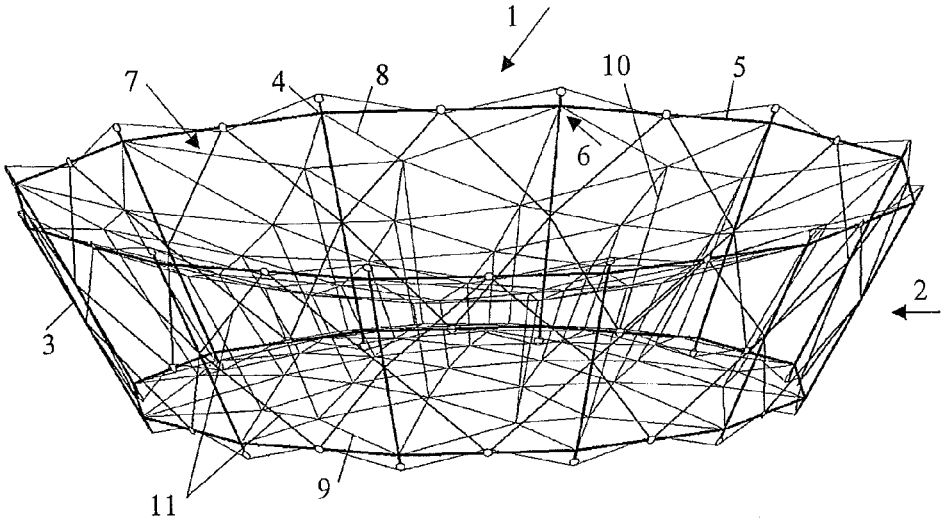
FIG. 2 shows a deployable reflector antenna frame with a conical shape according to an embodiment.

Each closed loop of vertical bars 3 and V-fold bars 5 forms a planar six-bar linkage occupying a facet of the frame structure. The deployable reflector antenna frame 1 is provided with a stretching frame 7 comprising an anterior net 8 having triangular cells, a rear net 9 having triangular cells, and connecting ties 10. The net 8 which consists of triangular cells is intended for forming the reflector profile and fastening the elastic reflective surface. Connection cables 11 are extended between each adjacent vertical 3 and horizontal 5 bars to stiffen the stable load-bearing ring 2. In order to reduce the weight and increase the stiffness and modularity of the deployable reflector antenna frame 1 and to ensure better stretching of the anterior net 8 which consists of cells, and to assume the high accuracy reflector profile respectively, it is preferably made in the form of a cone, as shown in FIG. 2.

Figures 3, 4:
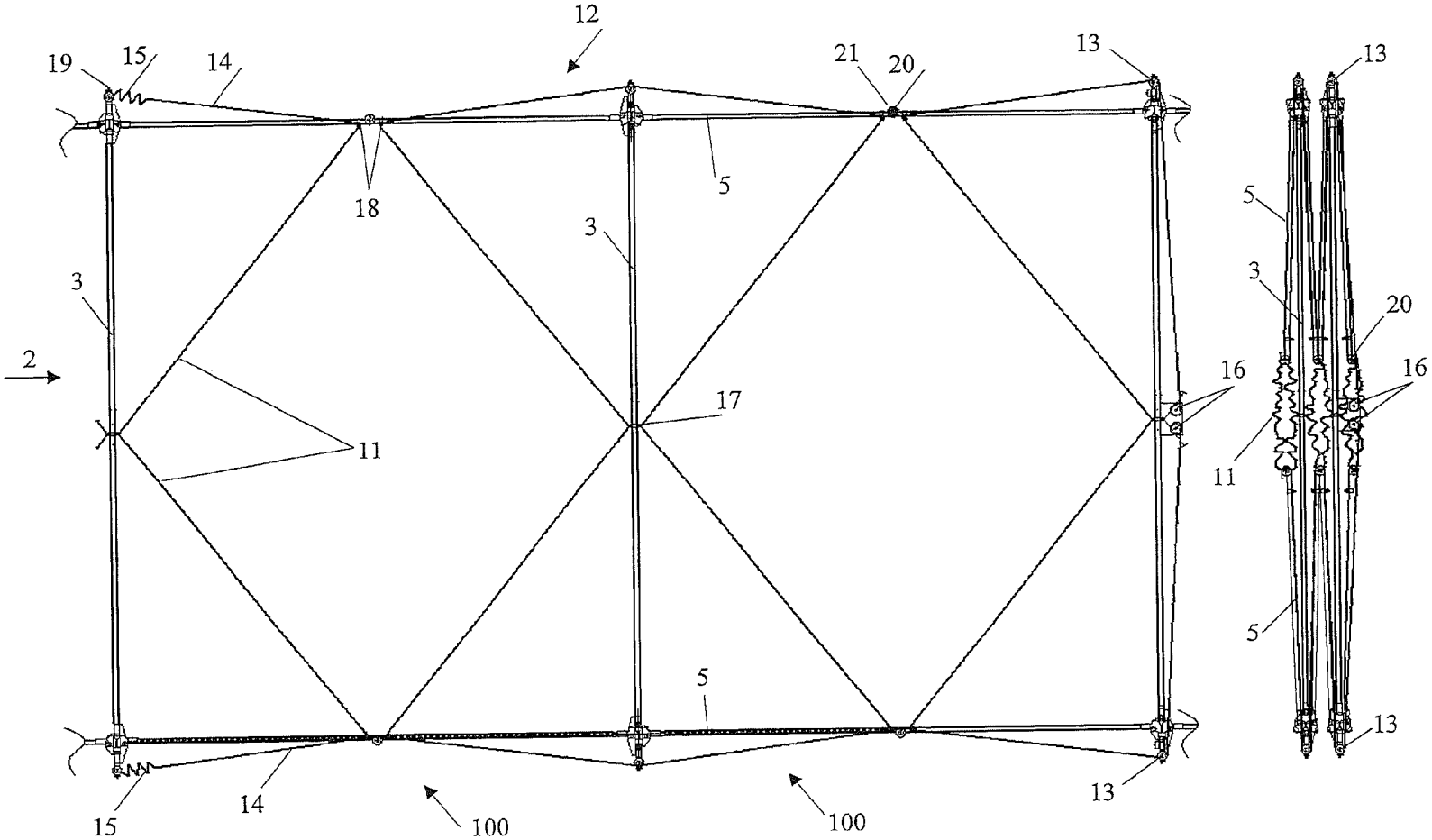
FIG. 3 shows two six-bar linkage structures in a deployed state according to an embodiment.
FIG. 4 shows a six-bar linkage structure in a folded state according to an embodiment.

FIG. 3 shows two lateral facets of the antenna reflector frame. A lateral facet is formed by a six-bar linkage structure 100. The six-bar linkage structure 100 is convertible from a folded state (shown in FIG. 4) into a deployed state (shown in FIG. 3). The six-bar linkage structure comprises two vertical bars 3 and four horizontal bars 5 (the terms "vertical" and "horizontal" relate to the illustration of the deployed state, as shown in FIG. 3). Each of the bars 3, 5 is coupled to two others by a hinge 4, 20 to form a closed loop. Reference number 20 denotes the hinge that couples two horizontal bars 5, whereas reference number 4 denotes the hinge that couples the horizontal bar 5 to a vertical bar 3. In the deployed state, the six-bar linkage structure 100 has a quadrilateral shape, wherein the two vertical bars 3 are located at opposing sides of the quadrilateral and two horizontal bars 5 are arranged in series on each of the other opposing sides at the upper and lower end of the load-bearing ring 2. In the folded (stowed) state, the reflector assembly occupies a smaller volume than when in the deployed state.

The deploying mechanism of the frame 1 comprises rollers 13 arranged on one side in the load-bearing ring 2 sections and of cables 14 that are guided by the rollers 13 so that the cables extend along the vertical 3 and horizontal 5 bars, respectively. One end portion of the cables 14 are connected to the vertical bars 3 at one section of the antenna frame 1 by means of springs 15, and the other end portion of the cables 14 are attached to drums 16 that are driven by electrical motors (not shown) and disposed in the middle of a vertical bar 3 of another section of the antenna frame with the capability of being rolled up on the drums 16.

The connections 11 of the load-bearing ring 2 are made in the form of cables connected in the middle parts 17 of the vertical bars 3 and in sites 18 adjacent to folding points of the V-fold bars 5, whereby a rhomb like structure is created in each ring 2 cell that ensures better stability of the ring in the deployed state. The load-bearing ring 2 vertical bars 3 are provided with upper and lower projecting ends 19. The cables 14 of the deploying mechanism 12 mounted in the load-bearing ring 2 sections are passed over the rollers 13 connected to the projecting ends 19 of the posts 3 and are passed over the rollers 21 connected to the hinges 20 of the V-fold bars 5. The rollers 21 located at the V-fold bars hinges are similar to rollers 13 on the vertical bars 3.

The motors are used for the transformation of the structure from the stowed state (FIG. 4) to the deployed state (FIG. 3) by spooling the cable 14 into the drums 16. In this spooling process the cable is pulled and travels over the rollers 13 and 21, transferring the motor action into a tensioning force. The resultant of tensioning forces on the rollers 21 and consequently on the hinge 20 is the cause of a lifting force of the V-fold bars 5, which results in the necessary moment to rotate them around their hinges 4 and to unfold the six-bar linkage 100 present in each facet of the ring structure. A minimum of one motor is provided, driving two drums 16, one for the upper chord 14 and one for the lower chord 14. More motors can be used for redundancy.

FIG. 4 shows a different cut-out portion of the antenna frame as FIG. 3. For instance FIG. 4 shows only the right and middle vertical bars 3 shown in FIG. 3, but not the left vertical bar 3. The wiggly line 11 illustrates the cables 11 in the folded state when the cables are not tensioned. In the folded state, the vertical bars 5 are aligned parallel to each other and their end portions are positioned next to each other. The V-fold bars 5 are folded to an acute V-form, wherein the center hinges 20 of the upper ring are located in between the vertical bars 3 along a straight line, wherein center hinges 20 of the same six-bar linkage structure are located opposite to each other.

Figure 5:
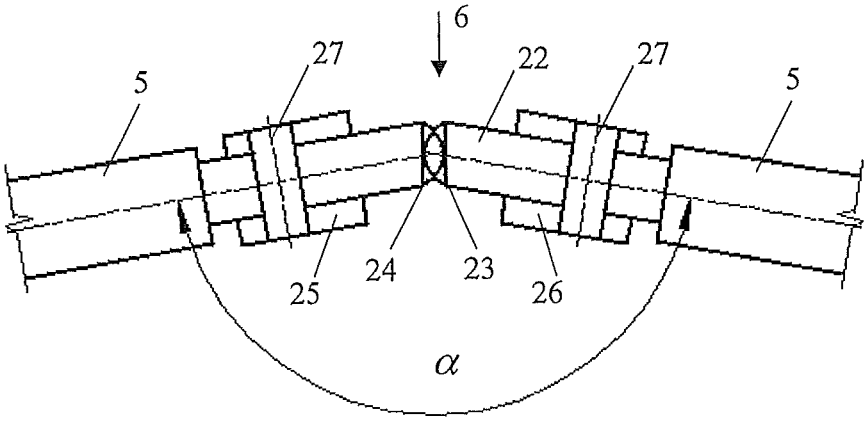
FIG. 5 shows a top view of the coupling portion between first and second bars of a six-bar linkage structure of the reflector antenna frame according to an embodiment.

FIG. 5 shows a top view of the hinge 4 comprising deployment synchronising means 6 which couples two end portions of the horizontal bars 5. The deployment synchronising means 6 also couples the vertical bar 3 with the vertical bars 5 as shown in the front view of FIG. 6. The deployment synchronising means 6 comprises the interacting pairs of gears 22 having teeth 23 and seats 24 with rounded surfaces for ensuring rolling over one another during the deployment process both in vertical and horizontal planes simultaneously and for inclining thereof outwardly. The hinge which connects the gears 22 to the vertical bars 3 is made in the form of brackets 25 and 26 having turning handles. Besides, the gears 22 are connected to the brackets 25 and 26 by means of rotary axes 27. In the embodiment where the load-bearing ring 12 has a structure of twelve equal facets, the brackets 25 and 26 are connected to the vertical bars 3 making an angle of 150 degrees between them, and the teeth 23 and seats 24 of the interacting pair of gears 22 that connect the V-fold bars 5 have the capability of rolling over one another by their surfaces rounded by approximately 3 degrees to create the maximum angles of 153 degrees and minimum angles of 147 degrees between them and to enhance the frame deployment reliability by compensating the inequal forces produced during the load-bearing ring 2 deployment. The load-bearing ring 2 vertical bars 3 are made in two portions and are connected to each other by means of the brackets 25 and 26 of the pair of gears 22, to create free spaces 28 between the portions of the vertical bars 3 at the levels of the pair of the gears 22 for interacting the teeth 23 and seats 24.

Both FIGS. 6 and 8 show a detailed view of the coupling portion comprising the synchronisation means 6 between the bars 3 and 5 in the deployed state. FIG. 6 shows a detailed view of the upper portion of the middle vertical bar 3 shown in FIG. 4, i.e. the vertical bar 3 that is shared by the two shown six-bar linkage structures 100. This vertical bar has no drums 16 or motor attached thereto. FIG. 8 shows a detailed view of the upper portion of the vertical bar 3 located on the right shown in FIG. 4. This vertical bar has drums 16 and a motor (not shown FIG. 4) attached thereto at its center portion. As shown in FIG. 6, the cable 14 extends horizontally to the right and left since it extends along the unfolded two upper horizontal bars 5. By contrast, as shown in FIG. 8, the cable 14 is guided by the pulley 13 to change its direction to extend downwards along the right vertical bar 3 to the drum 16.

FIG. 7 shows the upper portion of the vertical bar 3 shown in FIG. 6 in the folded state, and FIG. 9 shows the upper portion of the vertical bar 3 shown in FIG. 8 in the folded state. The angle of the cable 14 to the vertical bar 3 is narrower in FIG. 9 than in FIG. 7 since the cable 14 as shown in FIG. 9 extends towards the drum 19 located at the center portion of the right vertical bar 3 (cf. FIG. 3), whereas the cable 14 as shown in FIG. 7 extends along the bar 5 to the roller 21 of the center hinge 20 (cf. FIG. 4).

Features, components and specific details of the structures of the above-described embodiments may be exchanged or combined to form further embodiments optimized for the respective application. As far as those modifications are readily apparent for an expert skilled in the art they shall be disclosed implicitly by the above description without specifying explicitly every possible combination, for the sake of conciseness of the present description.

The invention claimed is:

1. A multi-faceted deployable antenna frame, comprising:

a six-bar linkage structure in a lateral facet of the antenna frame, the six-bar linkage structure being convertible from a folded state into a deployed state and having two first bars and four second bars, each bar being coupled to two others by a hinge to form a closed loop, wherein in the deployed state, the six-bar linkage structure has a quadrilateral shape;

a deployment means for deploying the antenna frame by moving the six-bar linkage structure from the folded state into the deployed state, the deployment means comprising:

a flexible, elongated member of a substantially inextensible material;

a first guiding means provided at an end portion of one of the first bars and coupled to the elongated member;

a storage means provided at the first bar that comprises the first guiding means for storing a part of the elongated member;

a driving means that is coupled to the elongated member to pull the elongated member to the storing means when deploying the antenna frame; and a second guiding means provided between two adjacent second bars, the elongated member being coupled to the second guiding means;

wherein a first end of the elongated member is attached to the storing means and a second end of the elongated member is coupled to another first bar, and wherein the elongated member extends between said first end and said second end of the elongated member along a plurality of second bars.

2. The multi-faceted deployable antenna frame according to claim 1, wherein the first guiding means is a pulley arranged on top of one of the hinges and projecting outwardly in a longitudinal direction of the first bar.

3. The multi-faceted deployable antenna frame according to claim 1, wherein the storage means is provided at a center portion of the first bar.

4. The multi-faceted deployable antenna frame according to claim 1, wherein the elongated member is a cable extending along at least four second bars.

5. The multi-faceted deployable antenna frame according to claim 1, further comprising a synchronising means provided at least at some of the hinges for synchronising the pivoting movement of the second bars relative to the first bars during deployment of the six-bar linkage structures.

6. The multi-faceted deployable antenna frame according to claim 5, wherein the synchronising means comprises an interacting pairs of gears having a toothed disc shape or comprising a slider strut slidably coupled to two adjacent first and second bars, wherein the slider strut moves upwardly along the first bar when the antenna frame is converted from the deployed state into the folded state.

7. The multi-faceted deployable antenna frame according to claim 1, further comprising connection cables extending between each adjacent first and second bars.

8. The multi-faceted deployable antenna frame according to claim 7, wherein the connection cables are attached to center portions of adjacent first and second bars, so that the connection cables form a rhombic shape in the deployed state of the six-bar linkage structure.

9. The multi-faceted deployable antenna frame according to claim 1, wherein the second end of the elongated member is coupled to the another first bar by a spring.

10. The multi-faceted deployable antenna frame according to claim 1, wherein the driving means comprises an electrical motor or a plurality of motors and the storage means comprises first and second drums, the first drum being configured to spool an elongated member extending along the plurality of second bars arranged at an upper side of the antenna frame and the second drum being configured to spool an elongated member extending along the plurality of second bars arranged at a lower side of the antenna frame.

11. The multi-faceted deployable antenna frame according to claim 1, wherein the first bars comprise upper and/or lower projecting ends.

12. The multi-faceted deployable antenna frame according to claim 1, having a conical shape created by different lengths of the elongated member extending along the plurality of second bars arranged at an upper side of the antenna frame and the elongated member extending along the plurality of second bars arranged at a lower side of the antenna frame.

13. The multi-faceted deployable antenna frame according to claim 1, comprising more than two lateral facets of identical or unequal shape forming a ring structure of regular or irregular polygonal shape.

14. A deployable antenna comprising the multi-faceted deployable antenna frame according to claim 1.

* * * * *